United States Patent [19]

Curfman

[11] Patent Number: 4,886,588

[45] Date of Patent: Dec. 12, 1989

[54] ELECTROLYTIC METHOD OF AND BATH FOR STRIPPING COATING FROM ALUMINUM BASES

[75] Inventor: Paul D. Curfman, Alvin

[73] Assignee: Union Carbide Corporation, Danbury, Conn.

[21] Appl. No.: 335,497

[22] Filed: Apr. 10, 1989

[51] Int. Cl.[4] ..... C25F 5/00

[52] U.S. Cl. ..... 204/146

[58] Field of Search ..... 204/146

[56] References Cited

U.S. PATENT DOCUMENTS 3,151,049 9/1964 Hendry ..... 204/146

OTHER PUBLICATIONS

Metals Handbook, 8th Edition, vol. 1, "Properties and Selection of Metals", American Society for Metals–Article Titled, "The Performance of Aluminum with Specific Chemicals".

"A Guide to the Resistance of Aluminum to Various Compounds" Kaiser Aluminum, pp. 136–141.

*Primary Examiner*—T. M. Tufariello

*Attorney, Agent, or Firm*—Cornelius F. O'Brien

[57] ABSTRACT

A method of stripping coatings from aluminum base materials using an electrolytic solution comprising a hydroxy organic acid such as tartaric acid; an alkali metal carbonate such as sodium carbonate; an aluminum corrosion inhibitor such as sodium silicate; and remainder water.

14 Claims, No Drawings

ELECTROLYTIC METHOD OF AND BATH FOR STRIPPING COATING FROM ALUMINUM BASES

FIELD OF INVENTION

The invention relates to a method for electrolytically stripping a coating, such as tungsten carbide-cobalt coating, from an aluminum base substrate using a stripping solution containing an aluminum corrosion inhibitor.

BACKGROUND OF THE INVENTION

Many types of articles are provided with coatings by high temperature, high velocity coating processes such as detonation gun plating, jet-plating and arc torch methods. After these coated parts have been in service sufficiently long to wear to a point where replacement is necessary it is desirable to have a method for quickly and economically removing the worn coating so that the base part can be coated again and placed back in service. In many instances the base part involves considerable expense in its original manufacture, so that reclaiming such parts can be of great importance. Also, in the course of applying wear resistant coatings it may occasionally be necessary to remove coatings that do not meet specifications, in which case reclaiming the base part is again desirable.

The prior art has devised several methods of removing coatings, such as refractory coatings, including mechanical removal by grinding. On cylindrical parts, for example, the coating may be ground off down to the base metal with removal of a small amount of the base metal below the original dimension to insure complete removal of the old coating and permit reacting. It has been found, however, that such procedure is time consuming, expensive, and not always advisable since grinding away a portion of the base metal to insure complete coating removal prevents the reclaimed base material from conforming to the original dimensions as specified by its user. Also, parts which are not cylindrical often may not be ground. Improper coating of such parts may necessitate their replacement and scrapping of the original part with its attendant expense and time delay.

A known stripping method uses electrolytic solutions such as aqueous sodium hydroxide or sodium carbonate. The coated part is immersed in the bath and connected as the anode of an electrical circuit while the steel tank containing the bath is connected as the cathode. This method has been found satisfactory for removal of some coatings but is not suitable for stripping certain mixed refractory coatings such as tungsten carbide-chromium carbide-nickel and chromium carbide-nickel-chromium. Also, the aforementioned sodium hydroxide or sodium carbonate electrolytic baths do not conveniently remove refractory coatings applied by the detonation plating process using inert gas dilution, as more fully described in U.S. Pat. No. 2,972,550.

U.S. Pat. No. 3,151,049 discloses an effective method for electrolytically stripping a substantially oxide-free, metal-containing refractory coating from a base material in which the coated base part is immersed as an anode in an electrolyte bath container, for example, in a steel tank serving as the cathode. The electrolyte bath for the stripping processes consists essentially of a soluble salt of an hydroxy organic acid, an alkali metal carbonate and the remainder water. Although this electrolyte bath solution is suitable for stripping many types of coatings from different base materials, when the base material is aluminum there is a tendency for the aluminum to be attacked by the alkali metal carbonate such as sodium carbonate. The attack on the aluminum could result in pitting, cracking and/or corrosion of the aluminum.

It is therefore an object of the present invention to provide a method of stripping coatings, such as metal carbide coatings, from all shapes of aluminum base materials in a rapid and economical manner without pitting, cracking and/or corroding of the base material.

It is another object of the present invention to provide a method of and electrolyte bath for stripping coatings from all shapes of aluminum base materials without necessitating removal of any of the aluminum base material.

These and other objects and advantages of the invention will become apparent from the following description.

SUMMARY OF THE INVENTION

The invention relates to a method of electrolytically stripping a coating from an aluminum base material comprising the steps:

(a) preparing an electrolyte solution comprising 0.02 to 2.00 mole percent of a soluble salt of a hydroxy organic acid; 2.5 to 5.5 mole percent of an alkali metal carbonate; 0.0004 to 0 04 mole percent of an aluminum corrosion inhibitor; and water;

(b) heating said electrolytic solution to about 100° F. to 200° F.;

(c) immersing a coated aluminum base material into said heated electrolytic solution; and (d) using the coated aluminum base material as an anode and with a cathode contacting said electrolytic solution passing an electric current through said electrolytic solution for a time period sufficient to strip the coating from the aluminum base material without damaging the aluminum base material.

As used herein an aluminum corrosion inhibitor is a material that will protect aluminum in an electrolyte bath solution from pitting, cracking or corrosion. Suitable aluminum corrosion inhibitors for use in this invention are sodium silicate ($Na_2SiO_3$), potassium dichromate ($K_2Cr_2O_7$) and sodium chromate ($Na_2CrO_4$). The amount of the aluminum corrosion inhibitor should for most applications be from 0.0004 to 0.04 mole percent of the stripping bath. Preferably, the aluminum corrosion inhibitor should be from 0.001 to 0.01 mole percent of the stripping bath and most preferably about 0.004 mole percent.

Preferably, the coated aluminum base material could be presoaked in a solution containing the aluminum corrosion inhibitor to form a protective film on the coated base material. For example, when using sodium silicate, a solution could be prepared using 0.003 to 0.30 mole percent sodium silicate with the remainder water. The coated aluminum base material could be immersed in this solution for from 30 seconds to 30 minutes, preferably from 1 minute to 5 minutes, whereupon a film of sodium silicate would form on the coated base material. Immediately thereafter the coated base material would be immersed in the electrolyte bath and a current fed through the bath sufficient to strip the coating without damaging the aluminum base.

The hydroxy organic acid for use in this invention may be monohydroxy or polyhydroxy of any soluble salt with sodium, potassium and ammonium salts of tartaric and citric acid being preferred. In particular, sodium tartrate is most preferred since it provides the desired concentration with the smallest amount of raw material due to its lower molecular weight. Soluble salts of qlycolic and tartonic acid might also be useful. Concentrations of the soluble salt below about 0.02 mole percent have been found to be unsatisfactory for effective stripping while concentrations above about 2.0 mole percent have been found not to appreciably improve the stripping rate. A range of about 0.2 mole percent to 0.9 mole percent of a soluble salt of a hydroxy organic acid has been found to be preferable for most applications with 0.6 mole percent being most preferable.

Although sodium carbonate is preferred as the means of providing the stripping bath with the desired current carrying capacity, other alkali metal carbonates such as potassium carbonate would be suitable. Also, the expression "alkali metal" is to be understood as including the ammonium radical as a functional equivalent thereof. Concentrations below about 2.5 mole percent of the alkali metal carbonate result in prohibitively low current carrying capacity of the electrolytic bath, while concentrations above about 5.5 mole percent do not appreciably increase the current characteristics of such bath. A range of about 3.0 to 4.6 mole percent of the alkali metal carbonate is preferred. Mutual solubility of the latter and the salt of a hydroxy organic acid in a common solution also has a moderating effect which helps to set the aforementioned composition limits.

Sodium carbonate has been found to attack aluminum at a rate that varies directly with concentration and temperature of the bath. Hydroxy organic acid, such as tartaric acid, generally causes negligible attack on aluminum when the temperature of the bath is maintained below about 125° F. In accordance with this invention, the use of the aluminum corrosion inhibitor will allow both higher concentrations of sodium carbonate and tartaric acid and permit operation of the bath at a higher temperature without attack of the aluminum.

The temperature of the electrolytic bath may be maintained in the range of about 100° F. to 200° F., preferably about 125° F. to 135° F. At temperatures below 100° F., the stripping rate is decreased while at temperatures above 200° F, the aluminum begins to be attacked. As stated above, with the addition of the aluminum corrosion inhibitor, the operating temperatures of the electrolytic bath can be increased without attack of the aluminum base material. Thus with the addition of the corrosion inhibitor, a more effective stripper operation is obtained.

The current density preferred in the practice of the electrolytic stripping method of the present invention varies for different coating compositions, coating thickness and shape of the coated part. Although current densities of 2 to 8 amperes per sq. in. have been used, the current should not be increased up to the level at which the aluminum base material becomes significantly attacked, and on the other hand could not be reduced to a value at which the stripping time becomes impractically long. In practice, the current density is preferably adjusted to a workable value of about 3 to 5 amperes per sq. in. Depending on the coating and its thickness, some parts may be stripped in 30 minutes while other parts may take 8 hours or longer. With the addition of the aluminum corrosion inhibitor to the electrolyte bath a film is deposited on the coated base material which prevents attack by the electrolytic bath. Thus, the finished part may remain in the bath without damage after stripping is complete.

During the stripping operation the base parts being stripped should preferably be kept completely submerged at all times. Partial emergence of the coated part from the electrolytic bath can in some cases produce a serious corrosive effect on the base material at the point of emergence. Care must also be taken to suspend the coated parts so that contact does not take place with the cathode to produce short circuiting and possible damage to the part. In some applications the tank containing the electrolytic solution could function as the cathode for the electrolytic bath.

Examples of suitable coating compositions that can be removed from aluminum base materials according to this invention would include tungsten carbide-cobalt, tungsten carbide-nickel, tungsten carbide-cobalt chromium, tungsten carbide-nickel chromium, chromium carbide-nickel chromium, chromium carbide-cobalt chromium, tungsten-titanium carbide-nickel, cobalt based alloys, oxide dispersion in cobalt alloys, copper based alloys, chromium based alloys, iron based-alloys, oxide dispersed in iron based-alloys, nickel, nickel based alloys, and the like.

It is believed that the available hydroxy groups of the soluble salts of hydroxy and polyhydroxy organic acids of the bath form ionized complexes with the binder material such as cobalt or nickel. These ionized complexes are then carried by the electrical current from the anode base part and deposited on the cathode. In contrast to non-ionized organic hydroxy compounds such as glycerine, the present salts are quite highly ionized and therefore provide high conductance and the necessary negative complexing ions to permit the metals to combine with the negative radical. The use of such salts in conjunction with an alkali metal carbonate also permits the high current densities required for rapid electrolytic stripping while the corrosion inhibitor prevents attack of the aluminum base material during stripping.

The operation of the present invention is further illustrated by the following examples.

EXAMPLE I

An electrolytic bath was prepared with 1.493 pounds per gallon (2.9 mole percent of soda ash (anhydrous sodium carbonate), 0.437 pound per gallon (0.61 mole percent) tartaric acid, 0.0054 pound per gallon (0.0034 mole percent) of sodium silicate meta-soluble (37%) and remainder water.

A second solution of approximately 0.25% sodium silicate (0.037 mole percent) with the balance water. This second solution is a presoak solution that could be used to form a protective film on the base material.

EXAMPLE II

Stripping of Tungsten Carbide-Cobalt Coating Applied by Detonation Gun Process On 7075 T-73 Aluminum Tube.

A 7075 T-73 aluminum tube approximately $2\frac{5}{8}$ inches outside diameter with approximately 0.005 inch thick coating of tungsten carbide-cobalt on the outside diameter was immersed in the presoak bath of Example I for 2 minutes. Immediately thereafter, the coated tube was immersed as an anode in an electrolytic bath of the composition described in Example I which was contained in a stainless steel tank (cathode). The electrolytic bath temperature was 125° to 135° F. The stripping operation was carried out at 6 volts DC. After 60 minutes the coating was completely removed. There was no evidence of attack or dimensional loss of the aluminum material and subsequent metallurgical evaluations showed no attack to the aluminum.

EXAMPLE III

Stripping of Tungsten Carbide-Cobalt Coating Applied by Plasma ARC Process On 6061 T-6510 Aluminum.

A 6061 T-6510 aluminum ring approximately 0.5 inch thick and 5½ inches outside diameter with approximately 0.008 inch thick coating of tungsten carbide-cobalt on the outside diameter was immersed in the presoak bath Example I for 2 minutes. Immediately thereafter, the coated ring was immersed as an anode in an electrolytic bath of the composition describe in Example I which was contained in a stainless steel tank (cathode). The electrolytic bath temperature was 125° to 135° F. The stripping operation was carried out at 6 volts DC. After 60 minutes the coating was completely removed. There was no evidence of attack or dimensional loss of the aluminum material and subsequent metallurgical evaluations showed no attack to the aluminum.

EXAMPLE IV

Stripping of Cobalt-Molybdenum-Chromium-Silicon Coating Applied by Detonation Gun Process On 6061 T-6 Aluminum.

A 6061 T-6 extrusion measuring 3.75 inches by 2 inches was coated with approximately 0.012 inch thick coating of cobalt-molybdenum-chromium-silicon (28 wt. % Mo, 17 wt % Cr, 3 wt. % Si and balance Co). The coated extrusion was immersed in the presoak bath of Example I for 2 minutes. Immediately thereafter, the coated extrusion was immersed as an anode in an electrolytic bath of the composition described in Example I which was contained in a stainless steel tank (cathode). The electrolytic bath temperature was 125° to 135° F. The stripping operation was carried out at 6 volts DC. After 70 minutes the coating was completely removed. Metallurgical evaluation showed no attack to the aluminum base material.

EXAMPLE V

Stability of 2024 Aluminum Ring in Electrolytic Solution.

A 4⅜ inch diameter by ⅝ inch long uncoated aluminum ring with a wall thickness of 1/8 inch was immersed in the presoak bath described in Example I for 1 minute. Immediately thereafter the ring was immersed as an anode in an electrolytic bath of the composition described in Example I which was contained in a stainless steel tank (cathode). The electrolytic bath temperature was 125° F. to 135° F. The operating voltage was set at 6 volts DC. The part remained in the bath for approximately 1 hour. Upon removal from the bath there was no visual or dimensional evidence of attack to the aluminum.

EXAMPLE VI

Stripping of Cobalt-Chromium-Molybdenum-Silicon Coating Applied by Detonation Gun Process On 6061 T-6 Aluminum Eighty 6061 T-6 extrusions, each having approximately 16 square inches of surface area and 4 3/16 square inches of 0.010/0.012 thick coated surface area, were immersed in the presoak bath described in Example I for 2 minutes. The parts were then immediately immersed as an anode in an electrolytic bath of the composition described in Example I. The electrolytic bath was contained in a carbon steel tank which was connected as the cathode. The operating voltage was set at 6 volts DC. The parts were stripped for 60 minutes. The coating was completely removed and there was no visual or dimensional evidence of attack to the aluminum extrusions.

EXAMPLE VII

Stripping of Tungsten Carbide-Cobalt Coating Applied by Detonation Gun Process On 6061 T-6 Aluminum A 6061 T-6 aluminum strip approximately ½ inch wide by 2 inches long by ⅛ inch thick was coated with approximately a 0.006 inch thick coating. The coated strip was immersed in the presoak bath for 15 seconds. Immediately thereafter the strip was immersed in an electrolytic solution of 0.54 mole percent tartaric acid, 3.52 mole percent sodium carbonate and 0.00072 mole percent sodium silicate contained in a glass receptacle. A strip of steel sheet metal approximately 1½ inch wide by 4 inches long by 1/16 inch thick was immersed in the electrolytic solution. The coated aluminum strip was connected as the anode and the steel strip was connected as the cathode. The electrolytic bath temperature was 145° F. to 155° F. The operating voltage was set at 5 volts DC. After 120 minutes the coating was completely removed. There was no visual or dimensional evidence of attack to the aluminum.

EXAMPLE VIII

A sequence of tests was conducted to determine the effect of varying concentrations of the aluminum corrosion inhibitor, sodium silicate. The base bath solution was 1.493 lb/gal sodium carbonate, 0.437 lb/gal tartaric acid, remainder water along with various amounts of sodium silicate. The electrolytic bath was heated to 125°-135° F. The operating voltage was set at 6 volts DC. All parts stripped were 6061 aluminum strips measuring ½ inch wide by 2⅛ inch long by 1/8 inch thick. The strips were coated with 0.005 inch/0.006 inch thick tungsten carbide base coating (82 wt. % tungsten, 14 wt. % carbide and 4 wt. % carbon).

Test 1

Sodium Silicate (37%)-0.0013 lb/gal (0.00084 mole %)
Stripping time - 15 minutes
Completely stripped, no attack Test 2

Sodium Silicate (37%)-0.0027 lb/gal (0.0017 mole %)
Stripping time - 15 minutes
Completely stripped, no attack Test 3

Sodium Silicate (37%)-0.0104 lb/gal (0.0066 mole %)

Stripping time - 15 minutes
Stripping incomplete, 0.002/0.003 coating remaining
Stripped for an additional 10 minutes, completely stripped, no attack Test 4

Sodium Silicate (37%)-0.0208 lb/gal (0.013 mole %)
Stripping time - 25 minutes
Stripping incomplete, 0.004/0.005 coating remaining
Stripped for an additional 60 minutes, 0.002/0.003 coating remaining.
Stripped for an additional 60 minutes, completely stripped, no attack.

It is to be understood that certain modifications can be made to the specific forms of the invention as disclosed herein, without departing from the scope of the invention.

What is claimed:

1. A method of electrolytically stripping a coating from an aluminum base material comprising the steps:

(a) preparing an electrolytic solution comprising 0.02 to 2.00 mole percent of a soluble salt of a hydroxy organic acid, 2.5 to 5.5 mole percent of an alkali metal carbonate; 0.0004 to 0.04 mole percent of an aluminum corrosion inhibitor; and water;
(b) heating said electrolytic solution;
(c) immersing a coated aluminum base material into said heated electrolytic solution; and
(d) using the coated aluminum base material as an anode and with a cathode contacting said electrolytic solution, passing an electric current through said electrolytic solution for a time period sufficient to strip the coating from the aluminum base material without damaging the aluminum base material.

2. The method of claim 1 wherein in step (a) the soluble salt of a hydroxy organic acid is selected from the group comprising sodium salts of tartaric and citric acid, potassium salts of tartaric and citric acid, and ammonium salts of tartaric and citric acid; the alkali metal carbonate is selected from the group comprising sodium carbonate and potassium carbonate, and the aluminum corrosion inhibitor is selected from the group comprising sodium silicate, potassium dichromate and sodium chromate.

3. The method of claim 1 wherein in step (a) the soluble salt of a hydroxy organic acid is present in an amount from 0.2 to 0.9 mole percent; the alkali metal carbonate is present in an amount from 3.0 to 4.6 mole percent; and the aluminum corrosion inhibitor is present in an amount from 0.001 to 0.01 mole percent; and in step (b) the electrolytic solution is heated from 100° F. to 200° F.

4. The method of claim 1 wherein in step (b) the electrolytic solution is heated from 120° F. to 160° F.

5. The method of claim 4 wherein in step (a) the soluble salt of a hydroxy organic acid is tartaric acid; the alkali metal carbonate is sodium carbonate; and the aluminum corrosion inhibitor is sodium silicate.

6. The method of claim 1 wherein before step (a) the coated aluminum base material is immersed in a presoak solution comprising an aluminum corrosion inhibitor dissolved in water so as to form a film of the aluminum corrosion inhibitor on said coated aluminum base material.

7. The method of claim 6 wherein the presoak solution comprises 0.003 to 0.30 mole percent of the aluminum corrosion inhibitor.

8. The method of claim 7 wherein the coated aluminum base material is immersed in the presoak solution from 30 seconds to 30 minutes.

9. The method of claim 1 wherein the coating on the aluminum base material is selected from the group comprising tungsten carbide-cobalt, tungsten carbide-nickel, tungsten carbide-cobalt chromium, tungsten carbide-nickel chromium, chromium carbide-nickel chromium, chromium carbide-cobalt chromium, tungsten-titanium carbide-nickel, cobalt based alloys, oxide dispersion in cobalt alloys, copper based alloys, chromium based alloys, iron based alloys, oxide dispersed in iron based alloys, nickel and nickel based alloys.

10. The method of claim 1 wherein in step (a) the soluble salt of a hydroxy organic acid is tartaric acid in an amount of about 0.6 mole percent; the alkali metal carbonate is sodium carbonate in an amount of about 3 mole percent; and the aluminum corrosion inhibitor is sodium silicate in an amount of about 0.004 mole percent; and in step (b) the electrolytic solution is heated from about 125° F. to 135° F.

11. The method of claim 10 wherein before step (a) the coated aluminum base material is immersed for a time period from 30 g seconds to 5 minutes in a presoak solution comprising from about 0.003 to 0.30 mole percent sodium silicate dissolved in water.

12. The method of claim 10 wherein the coating on the aluminum base material is selected from the group comprising tungsten carbide-cobalt, tungsten carbide-nickel, tungsten carbide-cobalt chromium, tungsten carbide-nickel chromium, chromium carbide-nickel chromium, chromium carbide-cobalt chromium, tungsten-titanium carbide-nickel, cobalt based alloys, oxide dispersion in cobalt alloys, copper based alloys, chromium based alloys, iron based alloys, oxide dispersed in iron based alloys, nickel and nickel based alloys.

13. An electrolytic solution for use in stripping a coating from an aluminum base material comprising 0.02 to 2.00 mole percent of a soluble salt of a hydroxy organic acid; 2.5 to 5.5 mole percent of an alkali metal carbonate; 0.0004 to 0.04 mole percent of an aluminum corrosion inhibitor; and water.

14. The electrolytic solution of claim 13 wherein the soluble salt of a hydroxy organic acid is selected from the group comprising sodium salts of tartaric and citric acid, potassium salts of tartaric and citric acid, and ammonium salts of tartaric and citric acid; the alkali metal carbonate is selected from the group comprising sodium carbonate and potassium carbonate, and the aluminum corrosion inhibitor is selected from the group comprising sodium silicate, potassium dichromate and sodium chromate.

* * * * *